US007481743B2

(12) United States Patent
Matsubara et al.

(10) Patent No.: US 7,481,743 B2
(45) Date of Patent: Jan. 27, 2009

(54) TRAINING MACHINE

(75) Inventors: Keiichi Matsubara, Kakogawa (JP); Hisashi Mori, Kobe (JP); Kojiro Minami, Kobe (JP); Atsushi Yamazaki, Kobe (JP); Setsu Muraki, Akashi (JP); Masatoshi Mukai, Akashi (JP)

(73) Assignee: Konami Sports & Life Co., Ltd, Tokyo (JP)

( * ) Notice: Subject to any disclaimer, the term of this patent is extended or adjusted under 35 U.S.C. 154(b) by 110 days.

(21) Appl. No.: 11/521,215

(22) Filed: Sep. 14, 2006

(65) Prior Publication Data

US 2007/0066453 A1 Mar. 22, 2007

(30) Foreign Application Priority Data

Sep. 22, 2005 (JP) ..... 2005-276166

(51) Int. Cl.
*A63B 22/00* (2006.01)

(52) U.S. Cl. ..... 482/51; 482/72; 482/126

(58) Field of Classification Search ..... 482/1–9, 482/51, 92, 110, 57, 93, 98, 69, 144, 62, 482/70–73, 126, 133, 134–139; 601/32, 601/34, 23, 24

See application file for complete search history.

(56) References Cited

U.S. PATENT DOCUMENTS 4,249,726 A * 2/1981 Faust ..... 482/4
4,479,647 A * 10/1984 Smith ..... 482/4
4,986,533 A * 1/1991 Lo ..... 482/62
5,209,223 A * 5/1993 McGorry et al. ..... 601/34
5,242,179 A * 9/1993 Beddome et al. ..... 280/233
5,335,649 A * 8/1994 Randall et al. ..... 601/24
5,352,185 A * 10/1994 Blauth et al. ..... 601/32
5,356,356 A * 10/1994 Hildebrandt et al. ..... 482/62
5,885,197 A * 3/1999 Barton ..... 482/144
6,361,479 B1 * 3/2002 Hildebrandt et al. ..... 482/72
6,368,251 B1 * 4/2002 Casler et al. ..... 482/4
6,558,299 B1 * 5/2003 Slattery ..... 482/93
6,632,161 B1 * 10/2003 Nir ..... 482/98
6,979,284 B2 * 12/2005 Curtis ..... 482/57
7,118,515 B2 * 10/2006 Kassel et al. ..... 482/57
2003/0153438 A1 * 8/2003 Gordon et al. ..... 482/92
2007/0004567 A1 * 1/2007 Shetty et al. ..... 482/69

FOREIGN PATENT DOCUMENTS

JP 09-294823 11/1997

* cited by examiner

*Primary Examiner*—Glenn Richman
(74) *Attorney, Agent, or Firm*—Jordan and Hamburg LLP

(57) ABSTRACT

A training machine 10 is for training the muscles of an upper body of a training person M sitting on a seat unit 50 provided in a machine main body, and is provided with an arm unit 60 disposed in the vicinity of the left and right sides of the seat unit 50, having a specified length and capable of making rotational movements against a specified load. The arm unit 60 has the bottom end thereof rotatably supported about shaft tubes 62 extending in horizontal transverse direction and has such a curved shape that a middle part thereof bulges out forward, and the leading end portions thereof serve as grips 611, 612. An electrical load generating unit 80 is provided to electrically give a load in accordance with an external force exerted to the arm unit 60, and locks the rotation of the arm unit 60 at a position where the portions of the arm unit 60 in the vicinity of the leading ends thereof are substantially horizontally held.

22 Claims, 10 Drawing Sheets

TRAINING MACHINE

BACKGROUND OF THE INVENTION

1. Field of the Invention

The present invention relates to a training machine for training muscles of a human body, mainly of an upper body.

2. Description of the Background Art

Conventionally, there have been known training machines (muscle training machines) for training muscles such as the one disclosed in Japanese Unexamined Patent Publication No. H09-294823. This training machine is for training the muscles of a human body, mainly those at and near upper arms, wherein a seat pad as a seat and a lumber support pad as a seat back rest are provided on a specified frame, and a foot rest projecting forward from the frame and an assist bar are provided at positions before the seat pad. Operation levers U-shaped in front view and mounted on the frame in such a manner as to be rotatable forward and backward about the bottom end thereof are provided at a middle position between the foot rest and the seat pad. This operation lever is connected with weights via a wire rope, and is inclined toward the seat pad by the weight of the weights.

A training person places his feet on the foot rest or assist bar while sitting on the seat pad, and trains the muscles at and near his upper arms by operating the operation lever forward and backward while holding a pair of grips formed at the leading ends of the operation lever. In other words, since a force against the weight of the weights needs to be exerted upon operating the operation lever forward, the muscles are trained at this time. Also upon returning the operation lever backward, the muscles are trained by slowly operating the operation lever against the weight of the weights.

A plurality of weights are hung on the wire rope while being placed one over another, and an amount of exercise conforming to the training person can be obtained by increasing or decreasing the number of the weights. The assist bar is for assisting the operation of the operation lever by placing the foot thereon.

Since various members such as the base end of the operation lever, the foot rest and the assist bar are arranged at positions before the seat pad as a seat in a training machine as disclosed in the above publication, there is a problem of being difficult to sit on the seat pad because these members stand as a hindrance. Particularly, if a training person is elderly, difficulty to sit becomes eminent. As a result, it is hard to call the training machine disclosed in the above publication as the one friendly to elderly people.

Further, since a plurality of weights are placed one over another to give a load to the operation lever, unit weights have to be increased or decreased every time the load is adjusted. There is also inconvenience that the adjustment of the load is cumbersome.

Furthermore, since the load can be generated only for the operation of moving the operation lever in one direction, no load can be given during the operation of moving the operation lever in the other direction, which causes a problem of poor versatility.

SUMMARY OF THE INVENTION

In view of such a situation, an object of the present invention is to provide a training machine having good usability, being particularly friendly to elderly people, easily operable for load adjustment and having rich versatility.

The present invention is directed to a training machine for training the muscles of an upper body of a training person sitting on a seat unit provided in a machine main body, comprising a pair of rotatable arms disposed in the vicinity of left and right sides of the seat unit; and an electrical load generating unit for electrically generating a load in accordance with external forces exerted to the arms, each arm having the bottom end thereof rotatably supported about a supporting shaft extending in horizontal transverse direction and having such a curved shape that a middle part thereof bulges out forward, a leading end portion thereof serving as a grip, and the rotation thereof being lockable by the electrical load generating unit.

With this construction, the training person can train the muscles of his upper body by exercising such training as to rotate the arms forward and backward against the specified load while sitting on the seat unit provided in the machine main body of the training machine and gripping the arms.

Since the arms have the bottom ends thereof rotatably supported about the supporting shafts extending from the seat unit in horizontal transverse direction intersecting with sitting direction, and have such a curved shape that the middle parts thereof bulge out forward, the arched arms can be utilized as hand rails when the training person sits on or get off the seat unit. By gripping the arms as the hand rails, the training person can easily sit on and get off the seat unit regardless of his height and situation (whether he is elderly or too young or physically handicapped). Here, the rotation of the arms can be locked by the electrical load generating unit. Since the rotation of the arms is locked in such a state as to assist movements of the training person to sit on and get off the seat unit, there is no such inconvenience that the arms inadvertently rotate when the training person sits on and gets off the seat unit. Therefore, the training person can safely sit on and get off the seat unit.

These and other objects, features, aspects and advantages of the present invention will become more apparent upon a reading of the following detailed description and accompanying drawings.

BRIEF DESCRIPTION OF THE DRAWINGS

FIGS. 5A and 5B are side views showing a state of training by the training machine according to the invention, wherein FIG. 5A shows a state where arched arms are set at positions closest to a seat unit and FIG. 5B shows a state where the arched arms are set at positions farthest from the seat unit.

DESCRIPTION OF THE PREFERRED EMBODIMENTS

Figure 1:
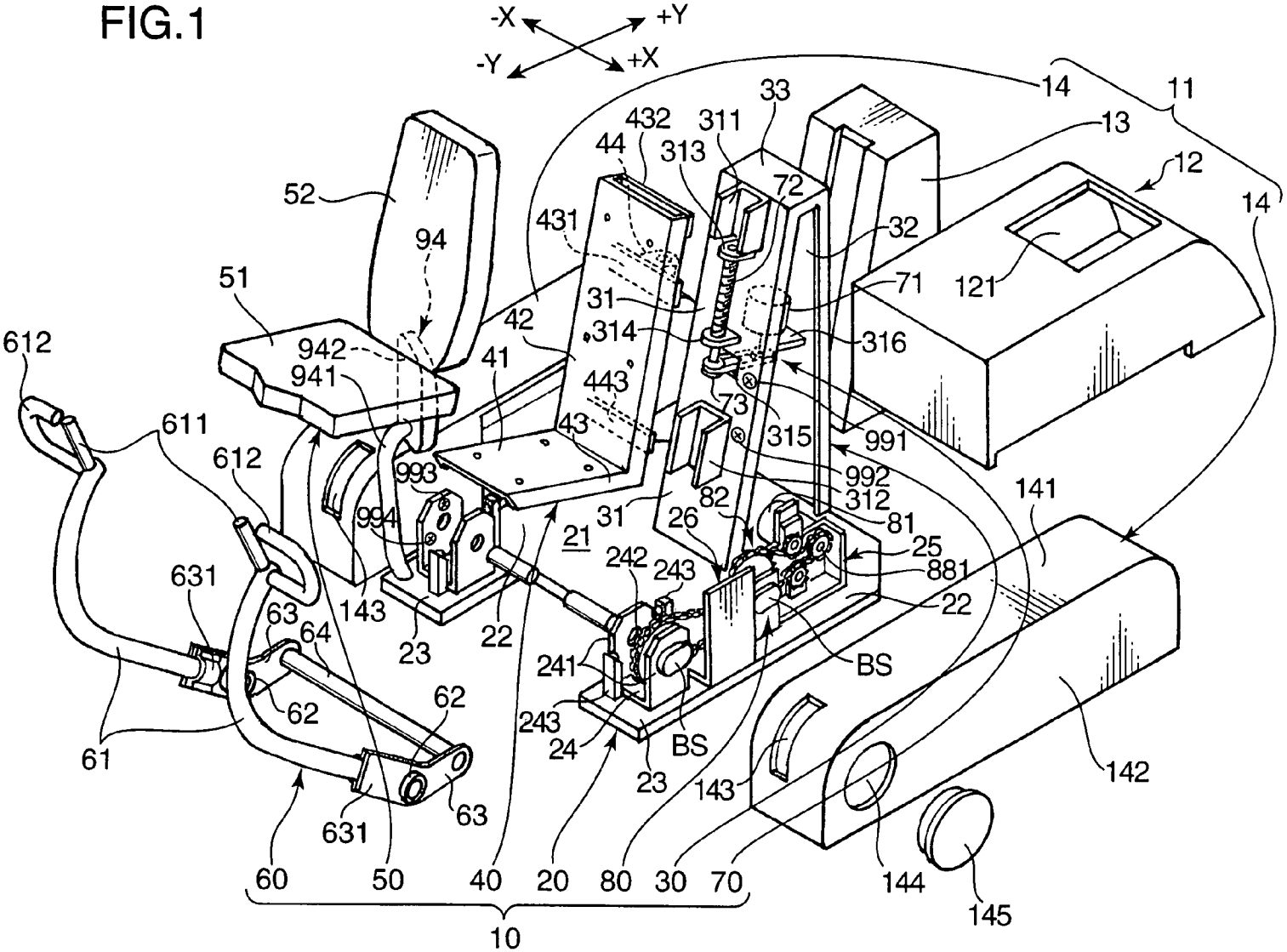
FIG. 1 is an exploded perspective view showing one embodiment of a training machine according to the invention.
Figure 2:
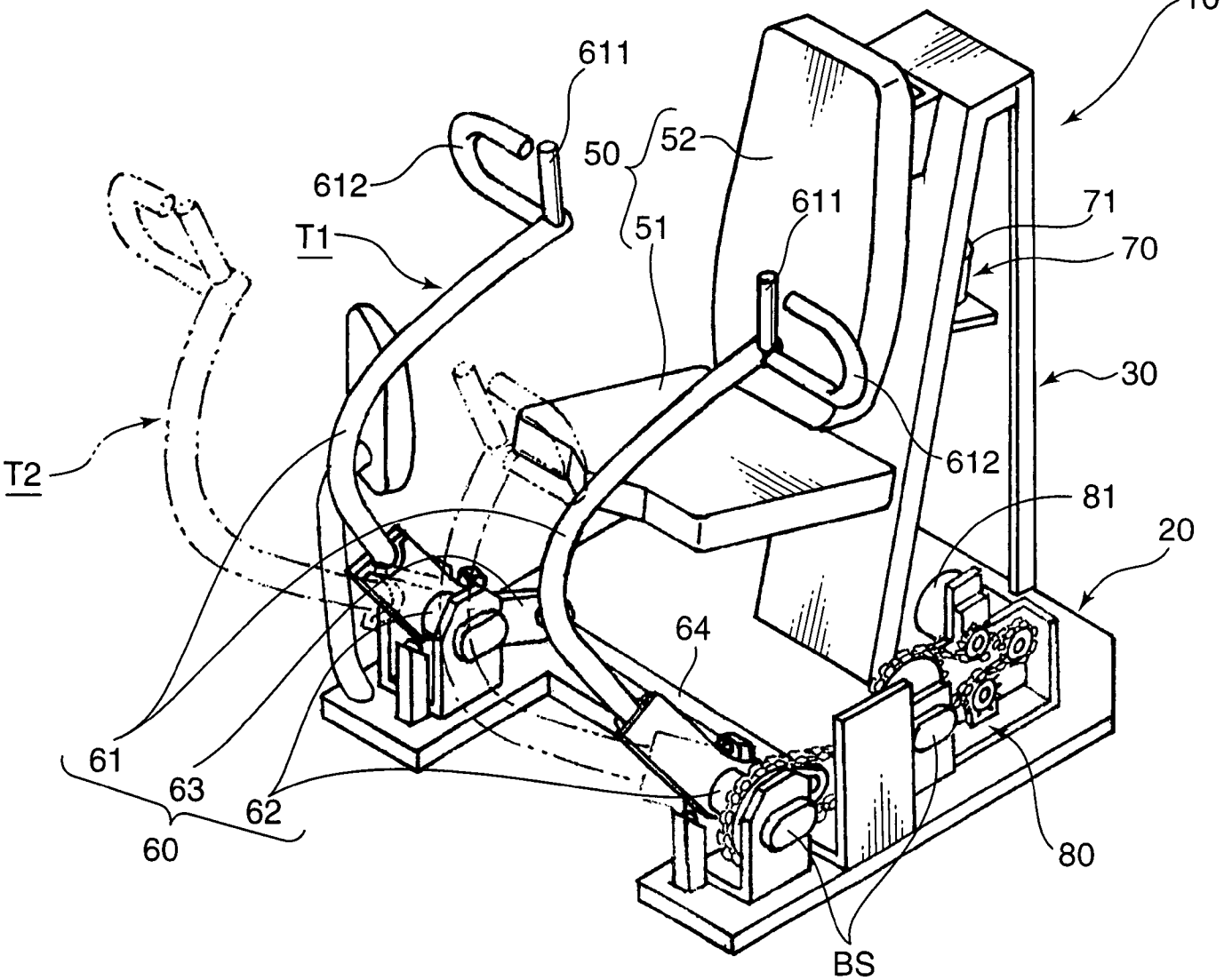
FIG. 2 is a perspective view showing an assembled state of the training machine shown in FIG. 1 with covers detached.
Figure 3:
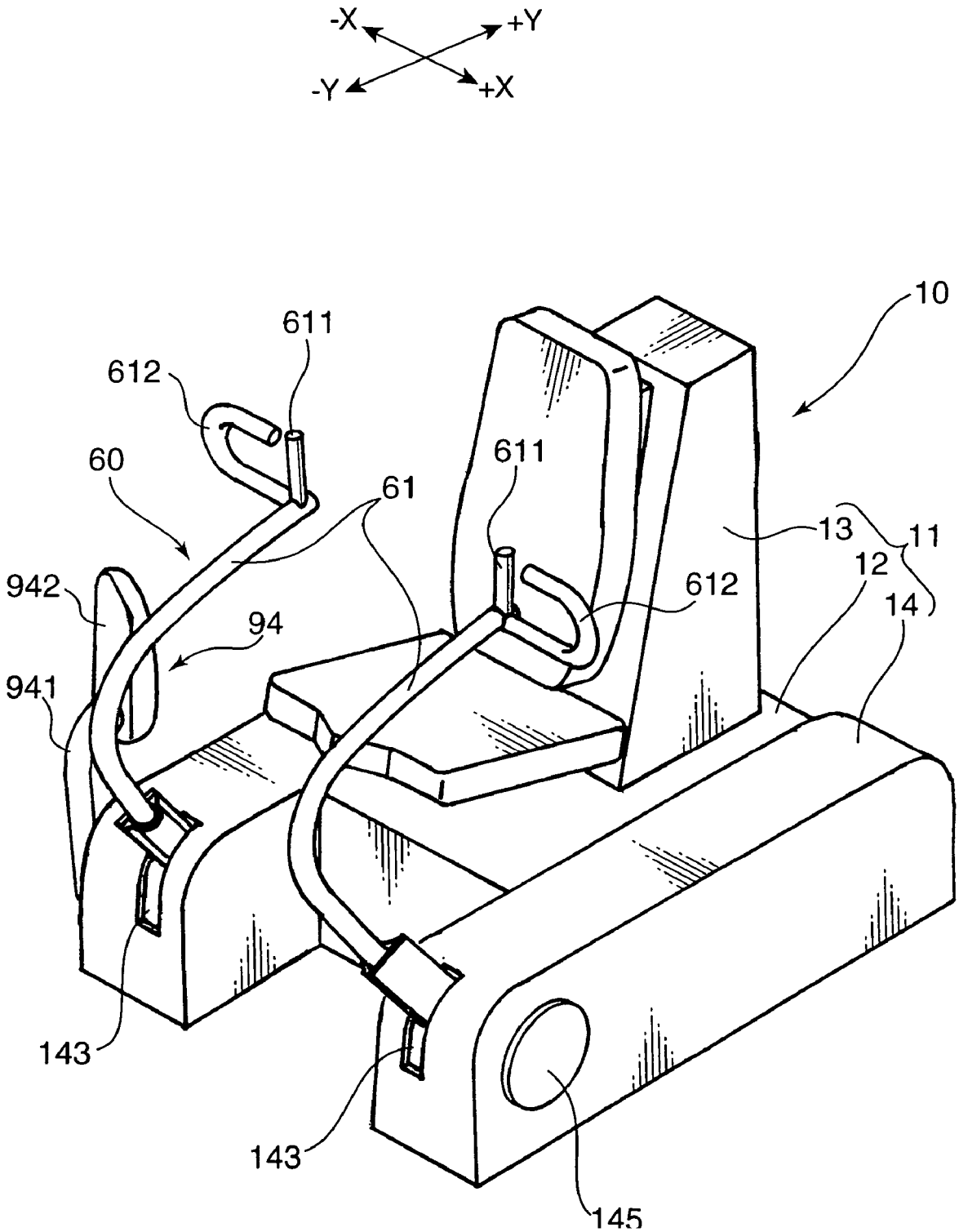
FIG. 3 is a perspective view showing the assembled state of the training machine shown in FIG. 1 with the covers mounted.

FIG. 1 is an exploded perspective view showing one embodiment of a training machine according to the present invention, and FIGS. 2 and 3 are perspective views showing an assembled state of the training machine shown in FIG. 1, wherein FIG. 2 shows a state where covers are detached and FIG. 3 shows a state where the covers are mounted. In FIGS. 1 to 3, X-X directions are referred to as transverse directions and Y-Y directions as forward and backward directions. Specifically, −X direction is referred to as leftward direction; +X direction as rightward direction; −Y direction as forward direction; and +Y direction as backward direction. Since transverse directions in FIGS. 1 to 3 are those when the training machine 10 is viewed from front, they are opposite to transverse directions a training person M (see FIG. 5) sitting on a seat unit recognizes.

As shown in FIG. 1, the training machine 10 has a basic construction provided with a base frame 20 in the form of a flat plate, a standing frame 30 standing at a transverse middle position of a rear side of the base frame 20, an elevating frame 40 connected with the standing frame 30 in such a manner as to be moveable upward and downward, a seat unit 50 fixed to the elevating frame 40, an arm unit 60 pivotably mounted at a front position of the base frame 20, an elevating mechanism 70 for moving the seat unit 50 upward and downward via the elevating frame 40, and an electrical load generating unit 80 for giving an electrical load to pivotal movements of the arm unit 60.

The base frame 20 includes a middle base frame 21 that is U-shaped in plan view and slightly longer in forward and backward directions, and a pair of left and right side base frames 22 projecting in opposite directions from the opposite transverse sides of the middle base frame 21 and extending in forward and backward directions. The respective side base frames 22 slightly project forward from positions of the front edge of the middle base frame 21, thereby forming projecting portions 23. Such a base frame 20 is shaped and dimensioned such that the feet of the training person M sitting on the seat unit 50 are positioned between this pair of projecting portions 23.

The standing frame 30 is for movably supporting the elevating frame 40 upward and downward via the elevating mechanism 70, has a tall trapezoidal shape in side view, and stands at the rear side of the middle base frame 21. Such a standing frame 30 includes a front frame 31 standing with a slight backward inclination from a substantially middle position with respect to forward and backward directions in the transverse center of the middle base frame 21, a rear frame 32 standing upright from the rear edge of the middle base frame 21 in such a manner as to face the front frame 31, and a top frame 33 bridging between the upper edges of the front and rear frames 31 and 32.

A pair of left and right upper rails 311 extending in vertical direction are provided at upper positions on the front surface of the front frame 31, and a pair of left and right lower rails 312 extending in vertical direction are provided at lower positions on the front surface of the front frame 31. These upper and lower rails 311, 312 are for guiding upward and downward movements of the elevating frame 40.

Further, an upper bracket 313 for rotatably supporting the upper end of a spiral rod 72 to be described later about a central axis thereof is provided at a position right below the upper rails 311 on the front frame 31, and a lower bracket 314 for rotatably supporting the bottom end of the spiral rod 72 about the central axis thereof is provided at a position above the lower rails 312. In addition, a belt introducing opening 315 through which a timing belt 713 to be described later is introduced is formed between the lower bracket 314 and the lower rails 312 in the frame front 31.

Such a standing frame 30 and the base frame 20 construct a machine main body according to the present invention.

The elevating frame 40 includes a bottom frame 41 that is L-shaped in side view and in the form of a flat plate inclined upward toward the front, and a lumber frame 42 standing substantially at right angle to the bottom frame 41 from the rear edge of the bottom frame 41. Such an elevating frame 40 includes a pair of left and right edge reinforcing plates 43 that extend in forward and backward directions while being bent downward at the respective left and right edges of the bottom frame 41 and extend in vertical direction while being bent backward at the left and right edges of the lumber frame 42. The presence of such edge reinforcing plates 43 makes the elevating frame 40 structurally strong.

A bridging plate 431 bridging between the pair of edge reinforcing plates 43 is provided at a substantially vertical middle position of the lumber frame 42, and an upper guidable plate 432 and a lower guidable plate 433 bridging between the pair of edge reinforcing plates 43 are provided at an upper and a lower parts of the lumber frame 42 in correspondence with the upper and lower rails 311, 312. The elevating frame 40 moves upward and downward with the upper and lower guidable plates 432, 433 held in sliding contact with the front edge surfaces of the upper and lower rails 311, 312.

A later-described nut member 44 to be engaged with the spiral rod 72 is fixed to the rear surface of the bridging plate 431. Accordingly, the elevating frame 40 moves upward and downward via the nut member 44 by rotating the spiral rod 72 in forward and reverse directions about the central axis thereof.

The machine main body according to the present invention is basically constructed by the base frame 20, the standing frame 30 and the elevating frame 40 as described above.

The seat unit 50 includes a seat 51 to be seated by the training person M and a seat back rest 52 on which the back of the training person M sitting on the seat 51 rests. These seat 51 and seat back rest 52 are formed by covering an assembly of a specified base plate and a pad member laminated on the upper surface of the base plate and made of a soft material such as a foamed synthetic resin with an outer covering. Such a seat 51 is secured to the upper surface of the bottom frame 41 by means of screws and the like, and the seat back rest 52 is secured to the front surface of the lumber frame 42 by means of screws and the like.

The upper surface of the seat 51 has a downward inclination of about 6° toward the back and a distance between the upper surface of the front edge of the seat 51 and the floor surface is set to be about 370 mm, so that people from small ones whose heights are in the order of 130 cm to those taller than 180 cm can easily sit on and get off and can stably sit on the seat 51.

The arm unit 60 is gripped and operated by the training person M sitting on the seat unit 50 to train the muscles at and near the upper arms, and includes a pair of left and right arched arms 61 whose middle parts arcuately bulge out forward, a pair of shaft tubes (supporting shafts) 62 fixed to the bottom ends of the respective arched arms 61 and having central axes extending in transverse direction, a pair of straight arms 63 projecting backward from the corresponding shaft tubes 62, and a bar-shaped bridging rod (bridging member) 64 bridging between the rear ends of the pair of straight arms 63.

On the other hand, an arm supporting bracket 24 U-shaped in front view is fixed to each of the pair of projecting portions 23 of the base frame 20. Each arm supporting bracket 24 has a pair of standing plates 241 opposed to each other and each formed with an insertion hole 242, into which the corresponding shaft tube 62 is inserted in sliding contact therewith. Bearings are fitted in with the shaft tubes 62 inserted in the insertion holes 242, and are supported in bearing cases BC fixed to the standing plates 241, whereby the arm unit 60 can be rotated in forward and reverse directions about the shaft tubes 62.

The arched arms 61 are dimensioned such that the upper ends thereof come to be located near the chest of the training person M sitting on the seat unit 50 by being rotating clockwise about the shaft tubes 62 with the shaft tubes 62 mounted in the insertion holes 242 of the arm supporting brackets 24. A straight grip 611 projecting in outward direction along a radius of curvature and an arcuate grip 612 projecting transversely outward and normal to the straight grip 611 are provided at the upper end of each arched arm 61. The upper end of the arcuate grip 612 is a free end opposed to the upper end of the straight grip 611. The training person M sitting on the seat unit 50 pivots the arched arms 61 about the shaft tubes 62 by gripping either the straight grips 611 or the arcuate grips 612 depending on the situation.

The straight arms 63 have the length thereof set in such a manner as not to interfere with the standing frame 30 with the shaft tubes 62 mounted in the arm supporting brackets 24, and has, at their front ends, connection fittings 631 extending in the extending direction of the arched arms 61. The arched arms 61 have the bottom ends thereof secured to the corresponding connection fittings 631 by means of bolts or the like, thereby being integral to the straight arms 63.

On the other hand, stoppers 243 are provided at the front and rear sides of the arm supporting bracket 24 on each projecting portion 23 of the base frame 20, and any further rotation of the arm unit 60 is prevented by the contact of the connection fittings 631 with these stoppers 243. In other words, a rotatable range of the arm unit 60 is set by the presence of the pair of stoppers 243.

The elevating mechanism 70 includes an elevating motor 71 vertically mounted on the rear surface of the front frame 31 of the standing frame 30, the spiral rod 72 having the upper end rotatably supported on the upper bracket 313 about the central axis thereof and the timing belt 73 for transmitting a driving force of the elevating motor 71 to the spiral rod 72.

On the rear surface of the front frame 31, a motor bracket 316 projects backward from a position slightly above the belt introducing opening 315, and the elevating motor 71 is vertically mounted on this motor bracket 316. A drive shaft of the elevating motor 71 projects down through the motor bracket 316, and a motor-side pulley is concentrically fixed to this projecting portion, whereas a rod-side pulley is concentrically fixed to the bottom end of the spiral rod 72. The timing belt 73 is mounted between the motor-side pulley and the rod-side pulley through the belt introducing opening 315, so that the driving force of the elevating motor 71 is transmitted to the spiral rod 72 via the timing belt 73.

Figure 4:
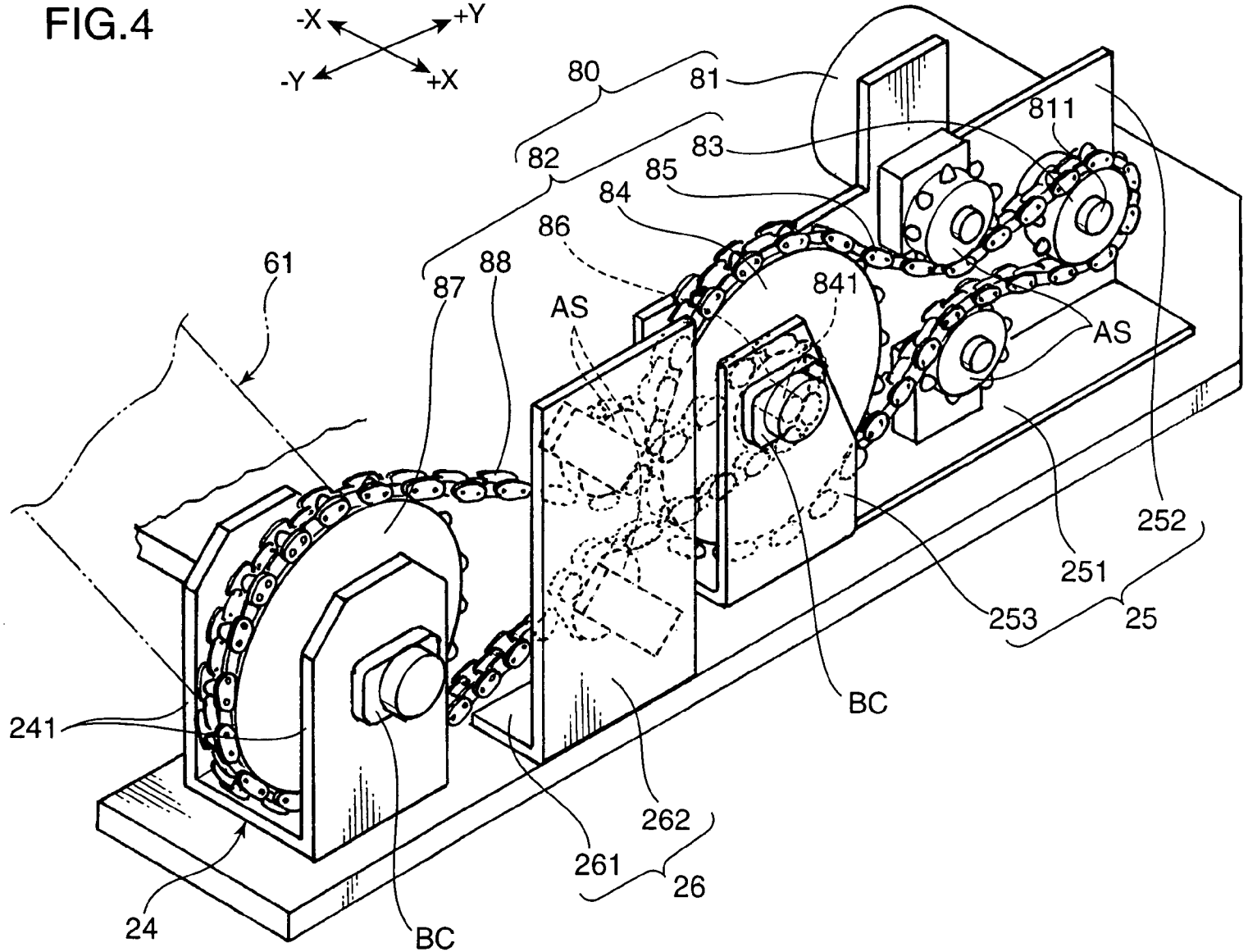
FIG. 4 is a partial enlarged perspective view of FIG. 1 showing one embodiment an electrical load generating unit.

FIG. 4 is a partial enlarged perspective view of FIG. 1 showing one embodiment of the electrical load generating unit 80. It should be noted that directions indicated by X and Y in FIG. 4 are as in the case of FIG. 1 (X indicates transverse directions (−X: leftward, +X: rightward) and Y indicates forward and backward directions (−Y: forward direction, −Y: backward direction). As shown in FIG. 4, the electrical load generating unit 80 includes a servo motor 81 for exerting a load to the arm unit 60 and a load transmitting mechanism 82 for transmitting the load given by the servo motor 81 to the arm unit 60.

On the other hand, a rear bracket 25 for supporting the servo motor 81 and a part of the load transmitting mechanism 82 is fixed at a rear position of the right side base frame 22, and an intermediate bracket 26 is fixed between the rear bracket 25 and the arm supporting bracket 24. The electrical load generating unit 80 can effectively exhibit its functions by being supported on the respective brackets 24 to 26.

The rear bracket 25 has a bottom plate 251 long in forward and backward directions, a left side plate 252 standing from the left edge of the bottom plate 251 and a right side plate 253 standing from a front position of the right edge of the bottom plate 251. The servo motor 81 is horizontally mounted while having a drive shaft 811 thereof inserted through the left side plate 252 of the rear bracket 25 at a rear position to located it on the right surface of the left side plate 252.

The load transmitting mechanism 82 includes a motor-side sprocket 83 concentrically fitted on the drive shaft 811 of the servo motor 81 in such a manner as to be rotatable together, an intermediate large-diameter sprocket 84 mounted between the left and right side plates 252 and 253 of the rear bracket 25, a motor-side chain 85 mounted between the motor-side sprocket 83 and the intermediate large-diameter sprocket 84, an intermediate small-diameter sprocket 86 provided to be concentric with and rotatable together with the intermediate large-diameter sprocket 84, an arm-side sprocket 87 mounted in the arm supporting bracket 24 in such a manner as to be concentric with and rotatable together with the shaft tube 62 of the arm unit 60, and an arm-side chain 88 mounted between the intermediate small-diameter sprocket 86 and the arm-side sprocket 87.

The intermediate large-diameter sprocket 84 and the intermediate small-diameter sprocket 86 are concentrically and integrally rotatably fitted on a sprocket shaft 841 rotatably mounted about the central axis thereof between the left and right side plates 252 and the 253 of the rear bracket 25. Ends of such a sprocket shaft 841 projecting out from the left and right side plates 252, 253 are supported in the bearings in the bearing cases BC fixed to the left and right side plates 252, 253, whereby the sprocket shaft 841 smoothly moves about its central axis.

A pair of idle sprockets AS whose circumferential surfaces are opposed to each other along vertical direction are provided substantially at middle positions of the left side plate 252 of the rear bracket 25 with respect to forward and backward directions, and the motor-side chain 85 is mounted while being squeezed by the pair of idle sprockets AS. Spacing between these idle sprockets AS is extendible, whereby a tension of the motor-side chain 85 can be suitably set.

The intermediate bracket 26 includes a bottom plate 261 rectangular in plan view and fixed to the side base frame 22, and a side plate 262 standing from the right edge of the bottom plate 261. A pair of idle sprockets AS whose circumferential surfaces are opposed to each other along vertical direction are provided on the side plate 262 of such an intermediate bracket 26, and the arm-side chain 88 is mounted while being squeezed by the pair of idle sprockets AS. Spacing between these idle sprockets AS is extendible, whereby a tension of the arm-side chain 88 can be suitably set.

In this embodiment, the motor-side sprocket 83 and the intermediate small-diameter sprocket 86 are set to have the same small diameter, and the intermediate large-diameter sprocket 84 and the arm-side sprocket 87 are set to have the same large diameter. In this embodiment, the large diameter is set to be about four times as long as the short diameter.

Accordingly, a torque given to the shaft tube 62 of the arm unit 60 is transmitted to the drive shaft 811 of the servo motor 81 while being reduced to 1/16.

The framework of the training machine 10 according to the present invention is completed as shown in FIG. 2 by successively assembling the respective components, i.e. the standing frame 30, the elevating frame 40, the seat unit 50, the arm unit 60, the elevating mechanism 70 and the electrical load generating unit 80 on the base frame 20 while relating them to each other, and the training machine 10 as shown in FIG. 3 is completed by fitting this framework with outer covers 11.

The outer covers 11 are made of a hard synthetic resin material, and include a middle cover 12 for covering the middle base frame 21, a standing cover 13 for covering the standing frame 30, and side covers 14 for covering the left and right side base frames 22. The middle cover 12 is formed to have an inverted U-shape in side view, and an escaping window 121 through which the standing frame 30 is introduced is formed in a ceiling portion thereof. The standing cover 13 is formed to be vertically long in conformity with the shape of the standing frame 30 and has open front and bottom sides to be fittable on the standing frame 30.

The side covers 14 are transversely symmetrically formed. Each side cover 14 is provided with a middle plate 141 having an inverted U-shape in side view and long in forward and backward directions, and side plates 142 for closing both left and right openings of the middle plate 141. A vertically extending oblong hole 143 through which the arched arm 61 is introduced is formed at a front corner portion of each middle plate 141, and a round maintenance hole 144 is formed at a position of the outer side plate 142 facing the arm supporting bracket 24. Normally, this maintenance hole 144 is closed by a round lid 145.

Figure 5B:
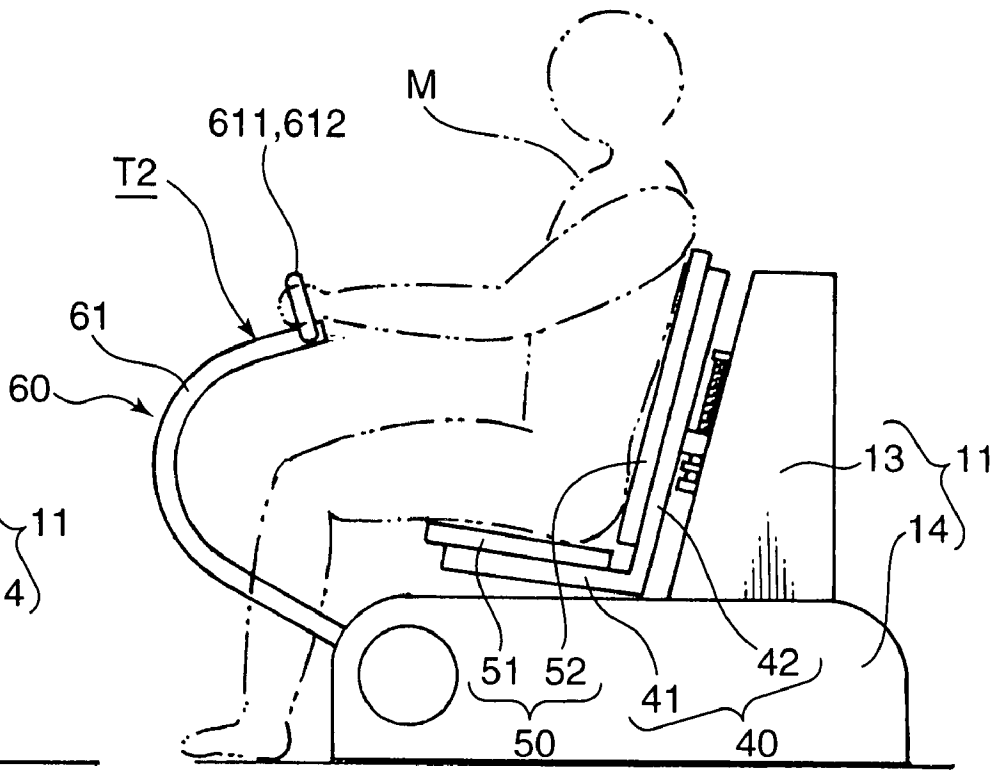
Figure 5A:
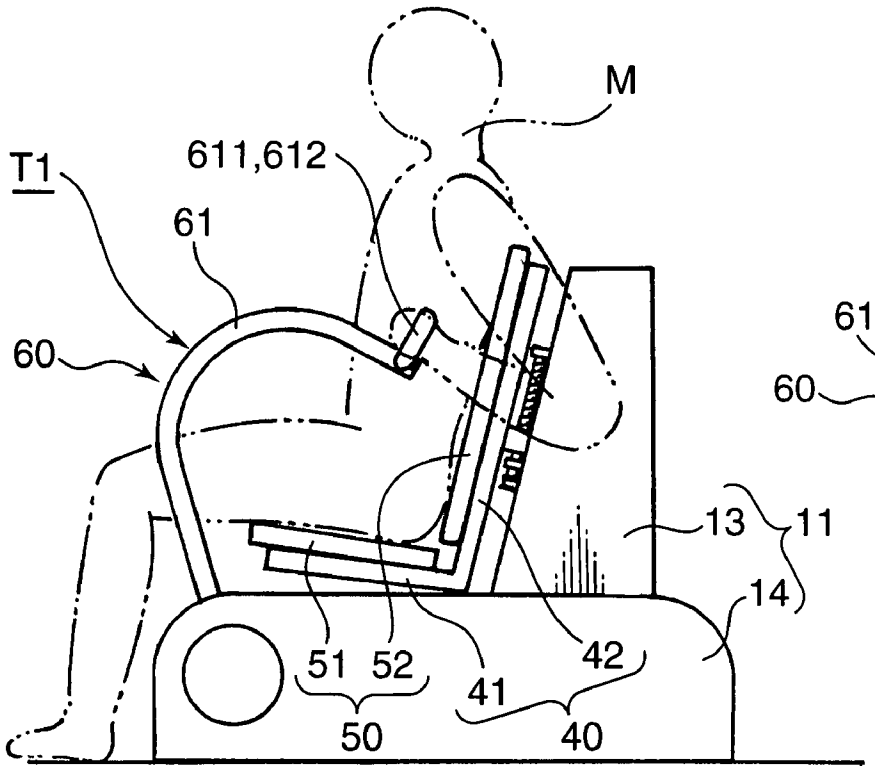

FIGS. 5A and 5B are side views showing states of training by the training machine 10 according to the present invention, wherein FIG. 5A shows a state where the arched arms 61 are set at closest positions T1 where they are closest to the seat unit 50 and FIG. 5B shows a state where the arched arms 61 are set at farthest positions T2 where they are farthest from the seat unit 50.

With the arched arms 61 of the arm unit 60 set at the closest positions T1, the straight grips 611 and the arcuate grips 612 at the leading ends of the arched arms 61 are very close to a vertical middle position of the seat back rest 52, whereby the arched arms 61 function as hand rails and a free space is defined before the seat unit 50 so that nothing exist there. Thus, the training person M needs not to step over extra upon sitting on the seat unit 50 and can easily reach the seat unit 50 from the front side of the seat unit 50, utilizing the arched arms 61 as hand rails. Therefore, even if the training person M is elderly or physically handicapped, the training machine 10 can be easily utilized.

As described in detail later, the arched arms 61 are locked at the closest positions T1 before the training is started and after the training is ended. Thus, the arched arms 61 can securely function as hand rails without rocking when the training person M sits on and gets off the seat unit 50.

The training person M sitting on the seat unit 50 grips the grips 611, 612 of the arched arms 61 set at the closest positions T1 by hand as shown in FIG. 5A and then stretch his arms out. Then, the arched arms 61 rotate in counterclockwise direction about the shaft tubes 62, and such a rotary movement is transmitted to the drive shaft 811 of the servo motor 81 via the arm-side sprocket 87, the arm-side chain 88, the intermediate small-diameter sprocket 86, the sprocket shaft 841, the intermediate large-diameter sprocket 84, the motor-side chain 85 and the motor-side sprocket 83.

Accordingly, by supplying power in such a manner as to generate a specified load in the servo motor 81 beforehand, the training person M receives a load as a reaction force to the operation of the arched arms 61, wherefore the muscles are trained by resisting this load.

By the training person M stretching his arms out, the arched arms 61 are set at the farthest positions T2 where they are farthest from the seat unit 50 as shown in FIG. 5B. If the training person M relaxes his arms in this state, the arched arms 61 return to the closest positions T1 (see FIG. 5A) by the driving force of the servo motor 81. It is also possible to give a load to the training person M upon returning the arched arms 61 set at the farthest positions T2 to the closest positions T1 by driving the servo motor 81 in reverse direction after the arched arms 61 are set at the farthest positions T2.

The muscles are trained by the training person M rocking the arched arms 61 between the closest positions T1 and the farthest positions T2. However, a rocking range of the arched arms 61 may not necessarily be the one defined between the closest positions T1 and the farthest positions T2, and the arched arms 61 may be rocked within a suitable range in conformity with a training menu set beforehand.

Figure 6:
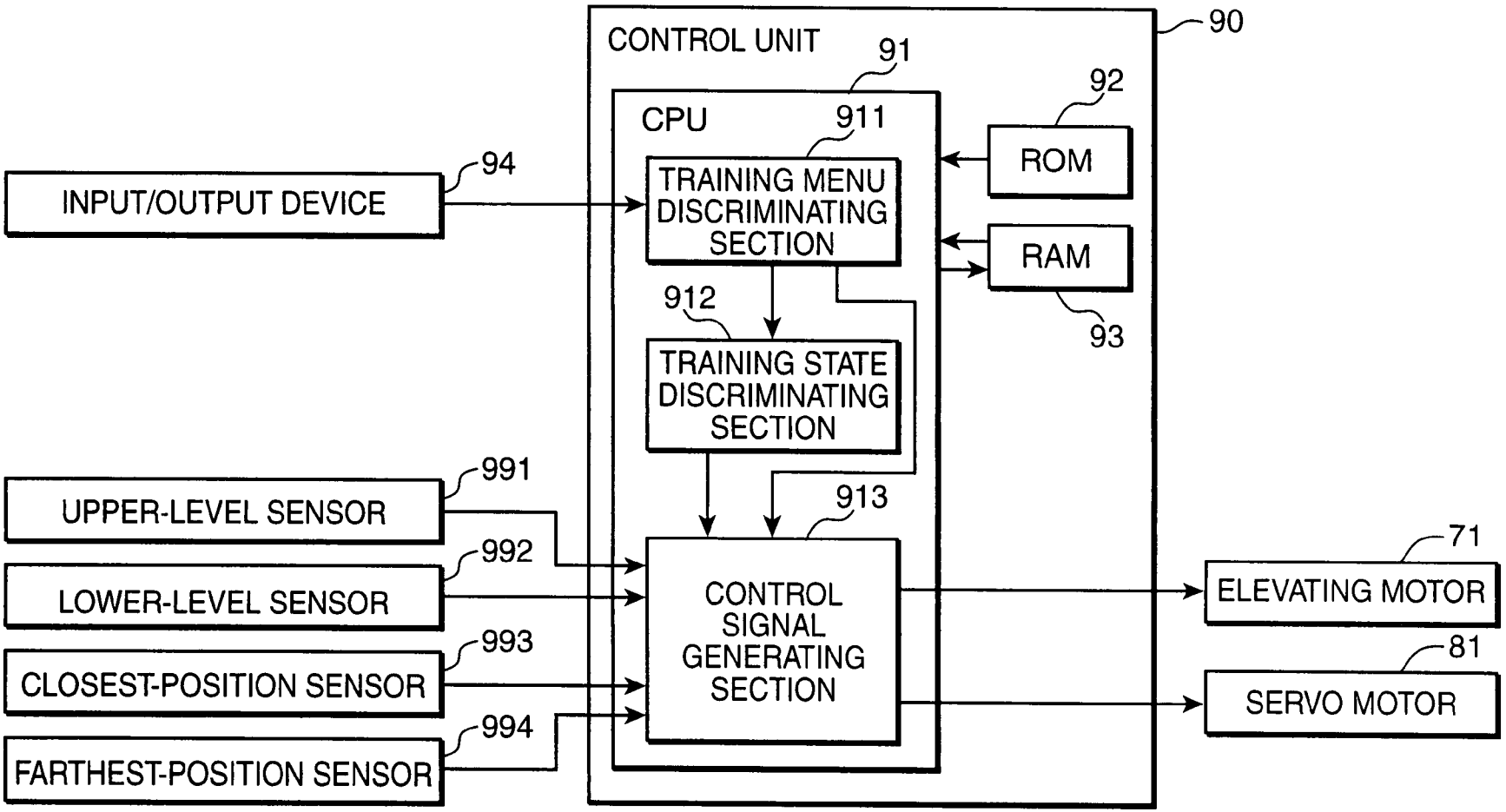
FIG. 6 is a block diagram showing one example of a control unit for controlling the operation of the training machine.

The control of the training machine 10 is described below with reference to FIG. 6 and, if necessary, also FIGS. 1 to 5. FIG. 6 is a block diagram showing one embodiment of a control unit 90 for controlling the operation of the training machine 10.

As shown in FIG. 6, the control unit 90 includes a CPU (central processing unit) 91 as an arithmetic processing unit, a ROM (read-only memory) 92 as a read-only storage provided in the CPU 91, and a RAM (random access memory) as a storage which is provided in the CPU 91 and in and from which data can be freely read and written. A program for controlling the operation of the training machine 10 and invariant data and the like necessary for the control are stored in the ROM 92, whereas intermediate data obtained as a result of arithmetic processing by the CPU 91 are temporarily saved in the RAM 93.

The CPU 91 is provided with a training menu discriminating section 911 for discriminating a training menu, a training state discriminating section 912 for discriminating the state of training in conformity with the training menu discriminated by the training menu discriminating section 911, and a control signal generating section (control signal output section) 913 for generating control signals to be outputted to the elevating motor 71 and the servo motor 81 in accordance with the discrimination results by the training menu discriminating section 911 and the training state discriminating section 912.

An input/output device 94 having a rectangular parallelepipedic shape is attached to the base frame 20 in order to enable the training menu discriminating section 911 to make a discrimination. As shown in FIG. 1, this input/output device 94 includes a supporting leg 941 standing on the projecting portion 23 of the left side base frame 22 while being slightly inclined outward, and a panel board (operation surface) 942 fixed to the upper end of the supporting leg 941. A vertical dimension of the supporting leg 941 is set such that the upper end thereof is located slightly above the seat unit 51. The panel board 942 is fixed to the leading end of the supporting leg 941 with the display surface thereof oriented in a direction toward the face of the training person M sitting on the seat unit 50.

Figure 7:
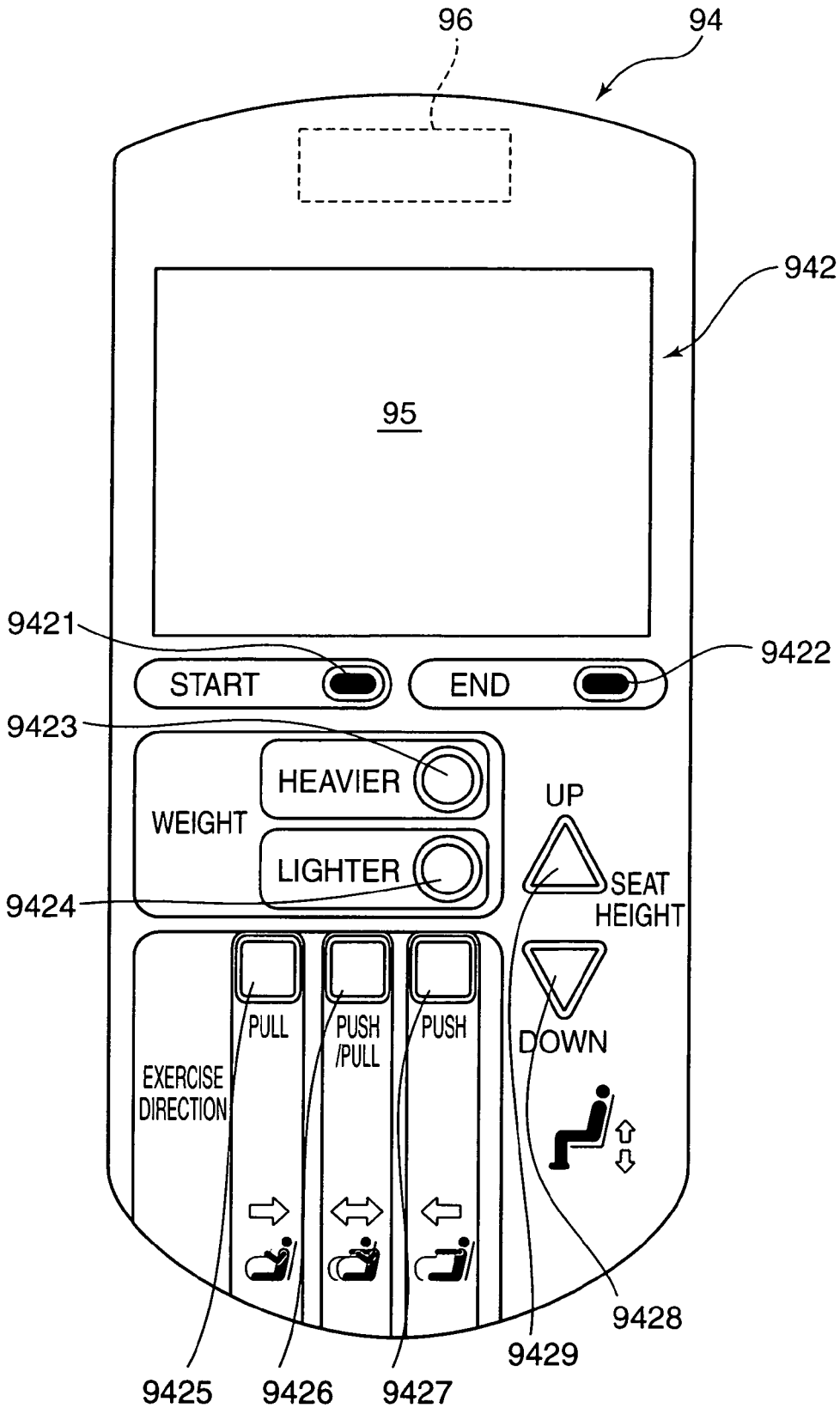
FIG. 7 is a front view showing one embodiment of a display surface of a panel board of an output device.

FIG. 7 is a front view showing one embodiment of the display surface of the panel board 942 of such an input/output device 94. As shown in FIG. 7, an entry section used to input a training menu is formed at the lower half of the display surface of the panel board 942 and a communication section is formed at the upper half thereof.

A start key 9421 and an end key 9422 are arranged side by side at an upper part of the entry section. The start key 9421 is pressed immediately before the training person M sitting on the seat unit 50 starts the training, whereas the end key 9422 is pressed by the training person M when the training is ended. The start key 9421 and the end key 944 are respectively written with "START" and "END", whereby the training person M can easily recognize the functions of the start key 9421 and the end key 9422.

A load setting portion used to set a training load is formed below the start key 9421, and an exercise-direction setting portion used to set an exercise direction, i.e. in which operating direction a load is exerted to the arched arms 61 is formed below the load setting portion. Further, a sitting-level setting portion used to set the height position of the seat unit 50 is formed below the end key 9422. The load setting portion is written with "WEIGHT"; the exercise-direction setting portion with "EXERCISE DIRECTION"; and the sitting-level setting portion with "SEAT HEIGHT", whereby the training person M can easily recognize functions of the load setting portion, the exercise-direction setting portion and the sitting-level setting portion.

The load setting portion is provided with a heavier load setting key 9423 written with "HEAVIER" and a lighter load setting key 9424 written with "LIGHTER". The load of the arched arms 61 is increased by one unit quality every time the heavier load setting key 9423 is pressed, whereas it is decreased by one unit quality every time the lighter load setting key 9424 is pressed.

The exercise-direction setting portion is provided with a pull-direction load setting key 9425 written with "PULL", both-direction load setting key 9426 written with "PUSH/PULL" and a push-direction load setting key 9427 written with "PUSH". Loads are given only when the training person M sitting on the seat unit 50 pulls the arched arms 61 toward him (backward) if the pull-direction load setting key 9425 is pressed; loads are given both when the training person M pulls the arched arms 61 and when he pushes the arched arms 61 if the both-direction load setting section 9426; and loads are given only when the training person M pushes the arched arms 61 forward if push-direction load setting key 9427 is pressed.

The sitting-level setting portion is provided with an upper level setting key 9429 written with "UP" and a lower level setting key 9428 written with "DOWN". The seat unit 50 is moved upward toward an upper level set beforehand when the upper level setting key 9429 is pressed while being moved downward toward a lower level set beforehand when the lower level setting key 9428 is pressed.

The communication section is for the communication of information with the control unit 90 and provided with an LCD (liquid crystal display) 95 for outputting and displaying input information from the entry section and discrimination results concerning the state of training discriminated by the training state discriminating section 912 in the form of character information.

Input information from the entry section is once inputted via a wireless communicator (receiver) 96 to the training menu discriminating section 911, where necessary discrimination is made concerning the training menu and then this discrimination result is outputted to the training state discriminating section 912 and the control signal generating section (control signal output section) 913. Then, the training state discriminating section 912 and the control signal generating section 913 perform suitable processings in accordance with the discrimination result.

In order for the training menu discriminating section 911 to make suitable discrimination concerning the training menu, various training menus corresponding to the input information from the entry section are stored in the form of a menu table in the ROM 92. Upon the input of the input information from the entry section, the training menu discriminating section 911 searches out a training menu in conformity with the input information from the menu table based on this input information, outputs the searched-out training menu to the training state discriminating section 912 so that the training state discriminating section 912 can discriminate the training state, and outputs a command signal to the control signal generating section 913 to let the control signal generating section 913 output such a control signal as to exert loads in conformity with this training menu to the arched arms 61.

Accordingly, the training state discriminating section 912 having receiving the signal from the training menu discriminating section 911 outputs the input information currently inputted via the entry section, a specific menu of training currently exercised, the progress of training (specifically, the number of operating the arched arms 61) and the like to the wireless communicator (receiver) 96 depending on the situation.

The control signal generating section 913 having received the command signal from the training menu discriminating section 911 outputs control signals conforming to the command signal to the elevating motor 71 and the servo motor 81.

In order to let the control signal generating section 913 properly output the control signals to the elevating motor 71 and the servo motor 81 in accordance with this command signal, the front frame 31 of the standing frame 30 is provided with an upper-level sensor 991 for detecting that the seat unit 50 is located at an upper level and a lower-level sensor 992 for detecting that the seat unit 50 is located at a lower level. Further, the standing plate 241 of the arm supporting bracket 24 mounted on the left side base frame 22 is provided with a closest-position sensor 993 for detecting that the arched arms 61 are set at the closest positions T1 to be closest to the training person M and a farthest-position sensor 994 for detecting the arched arms 61 are set at the farthest positions T2 to be farthest from the training person M.

If the command signal from the training menu discriminating section 911 is for letting the seat unit 50 move upward toward the upper level, the control signal generating section 913 outputs, after outputting a control signal to move the seat unit 50 upward to the elevating motor 71, a control signal to stop the driving to the elevating motor 71 upon the input of a detection signal from the upper-level sensor 991. Accordingly, the seat unit 50 moves upward toward the upper level when the upper level setting key 9429 of the panel board 942 is pressed, and moves downward toward the lower level when the lower level setting key 9428 is pressed.

In accordance with the command signal from the training menu discriminating section 911, the control signal generating section 913 outputs a preset control signal to the servo motor 81 based on whether the closest-position sensor 993 or the farthest-position sensor 994 is detecting the position of the arched arm 61.

Accordingly, the servo motor 81 is driven in such a state as to increase the loads to the movements of the arched arms 61 if the heavier load setting key 9423 (see FIG. 7) of the panel board 942 is pressed, while being driven in such a state as to reduce the loads to the movements of the arched arms 61 if the lighter load setting key 9424 is pressed.

Further, if the pull-direction load setting key 9425 (push-direction load setting key 9427) of the panel board 942 is pressed, the servo motor 81 is controlled to give the loads to the movements of the arched arms 61 when the arched arms 61 are operated from the farthest positions T2 (closest positions T1) to the closest positions T1 (farthest positions T2) while giving no loads to the movements of the arched arms 61 when the arched arms 61 are operated from the closest positions T1 (farthest positions T2) to the farthest positions T2 (closest positions T1).

Figure 8:
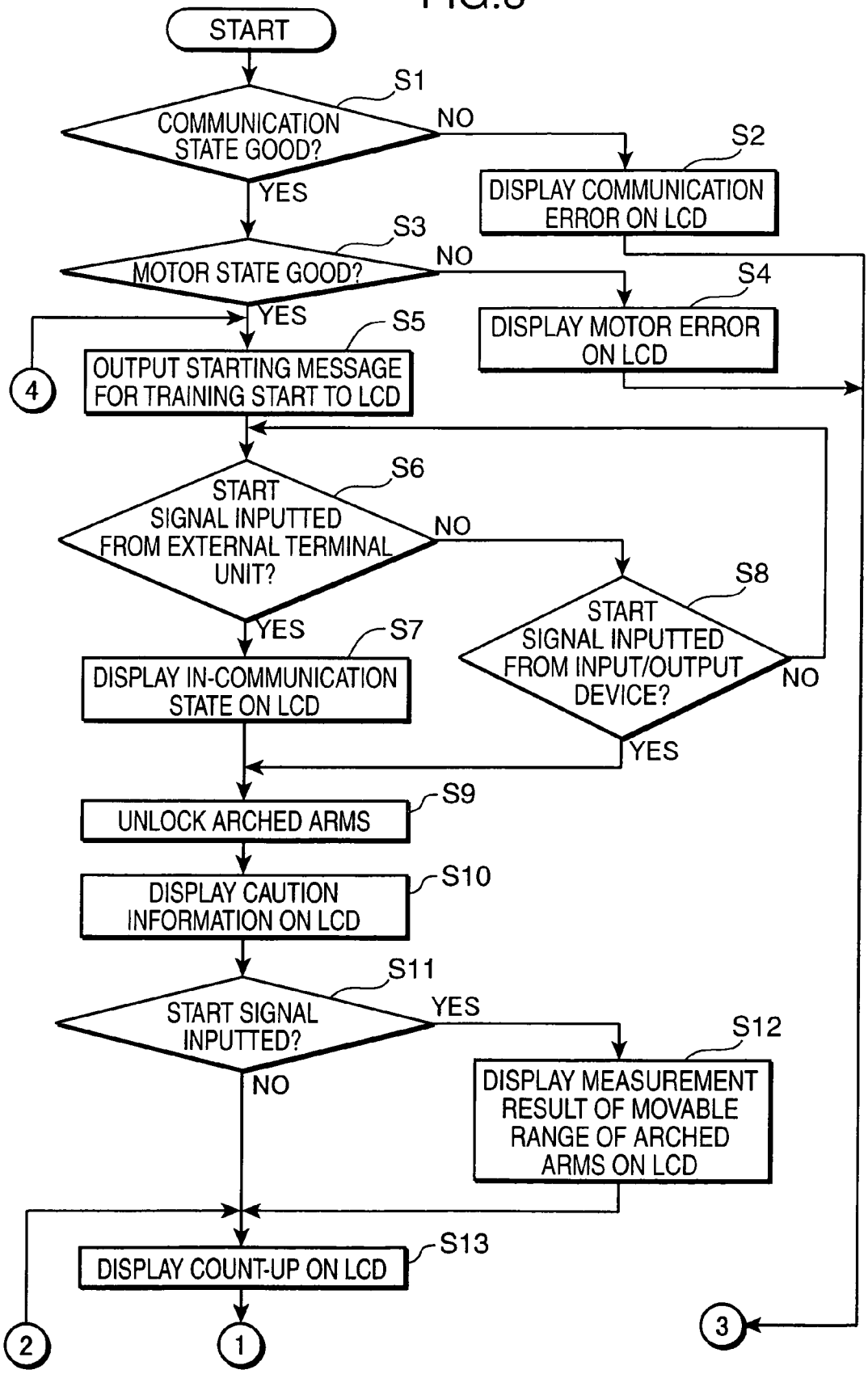
FIG. 8 is a front half of a flow chart showing one embodiment of a control flow by the control unit.
Figure 9:
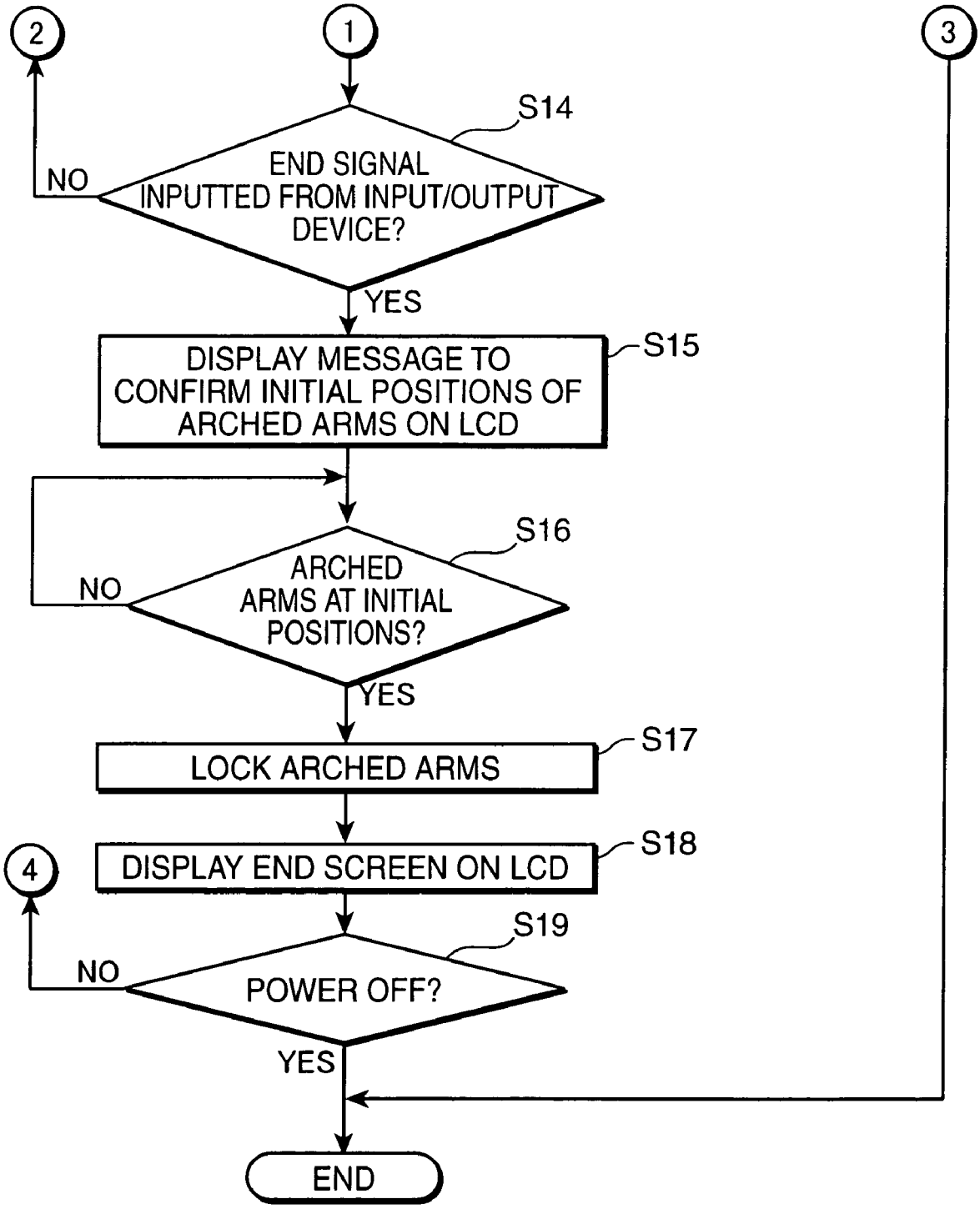
FIG. 9 is a rear half of the flow chart showing one embodiment of the control flow by the control unit.

FIGS. 8 and 9 are a flow chart showing one embodiment of a control flow by the control unit 90, wherein FIG. 8 shows the front half and FIG. 9 shows the rear half. When an unillustrated power switch disposed at a suitable position of the training machine 10 is turned on, the control of the training machine 10 by the control unit 90 is started and whether or not the state of communication via a communication line is good is first discriminated in Step S1. If the state of communication is faulty (NO in Step S1), the control is ended after a faulty state of communication (communication error) is displayed on the LCD 95 (Step S2). If the state of communication is good (YES in Step S1), whether or not the states of the elevating motor 71 and the servo motor 81 are good is discriminated in Step S3. If either one or both of them are faulty (NO in Step S3), the elevating motor 71 and/or the servo motor 81 are/is faulty (motor error) is displayed on the LCD 95 (Step S4) and the control is ended.

If the motor is in a good condition in Step S3, a starting message for the start of the training is displayed on the LCD 95 (Step S5). The message here would be, for example, "Straighten your back. Press START". The training person M sits on the seat unit 50 with this message displayed. At this time, the arched arms 61 are locked by the servo motor 81 so as not to move while being set at the closest positions T1 (see FIG. 1), wherefore the training person M can easily sit on the seat 51 while utilizing the arched arms 61 as hand rails.

Subsequently, whether or not a start signal has been inputted from an external terminal unit (external operating device) (the external terminal unit is used and a start key 9421 thereof has been pressed) is discriminated in Step S6. If the start signal has been inputted (YES in Step S6), an in-communication state is displayed on the LCD 95 (Step S7). On the other hand, if no start signal has been inputted from the external terminal unit, whether or not a start signal has been inputted from the input/output device 94 is discriminated assuming that the input/output device 94 is used (Step S8).

Following Step S7 or in the case of YES in Step S8, the arched arms 61 having been locked by supplying a specified power to the servo motor 81 is unlocked in response to a control signal outputted from the control signal generating section 913 to the servo motor 81 (Step S9), whereby the arched arms 61 become rotatable about the shaft tubes 62 by a specified load set beforehand. In this way, the training machine 10 enables the training person M to exercise training by rocking the arched arms 61 forward and backward. In this embodiment, caution information is displayed in Step S10 by way of precaution. The caution information may include sentences such as "Exercise with suitable weight while keep breathing. Press "START" in the case of measuring movable range".

Subsequently, whether or not a start signal has been inputted by pressing the start key 9421 is discriminated again (Step S11). If the start signal has been inputted (YES in Step S11), the movable range (moving path) of the arched arms 61 is displayed in the form of a line graph on the LCD 95 (Step S12). For such a display, an unillustrated arm path sensor is provided at a specified position of the base frame 20, and the line graph is obtained by the detection of this arm path sensor. If no start signal has been inputted in Step S11, Step S13 is performed without measuring the movable range.

Subsequently, the training person M exercises actual training by rocking the arched arms 61. During this time, the cumulative operation number (count-up information) of the arched arms 61 incremented by one every time the training person M operates the arched arms 61 is displayed on the LCD 95 (Step S13), and whether or not an end signal has been inputted from the input/output device 94 is subsequently discriminated (whether or not the end key 9422 has been pressed is discriminated) (Step S14). This routine returns to Step S13 if no end signal has been inputted (NO in Step S14), whereas a message (e.g. "Good training! Return arms to initial positions") is displayed on the LCD 95 to urge the training person M to return the arched arms 61 to initial positions (Step S15) when the end signal is inputted (when the end key 9422 is pressed).

Subsequently, whether or not the arched arms 61 have been returned to the initial positions (whether or not the arched arms 61 are set at the closest positions T1) is discriminated (Step S16). When being set at the closest positions T1 by the training person M (YES in Step S16), the arched arms 61 are so locked as not to move (Step S17). After an end screen showing the end of the training (e.g. with a sentence "Arms are locked") is displayed on the LCD 95 (Step S18), whether or not the power supply has been switched off (Step S19) is discriminated. This routine returns to Step S4 if the power supply is ON (NO in Step S19), whereas the control ends if the power supply is OFF.

Figure 10:
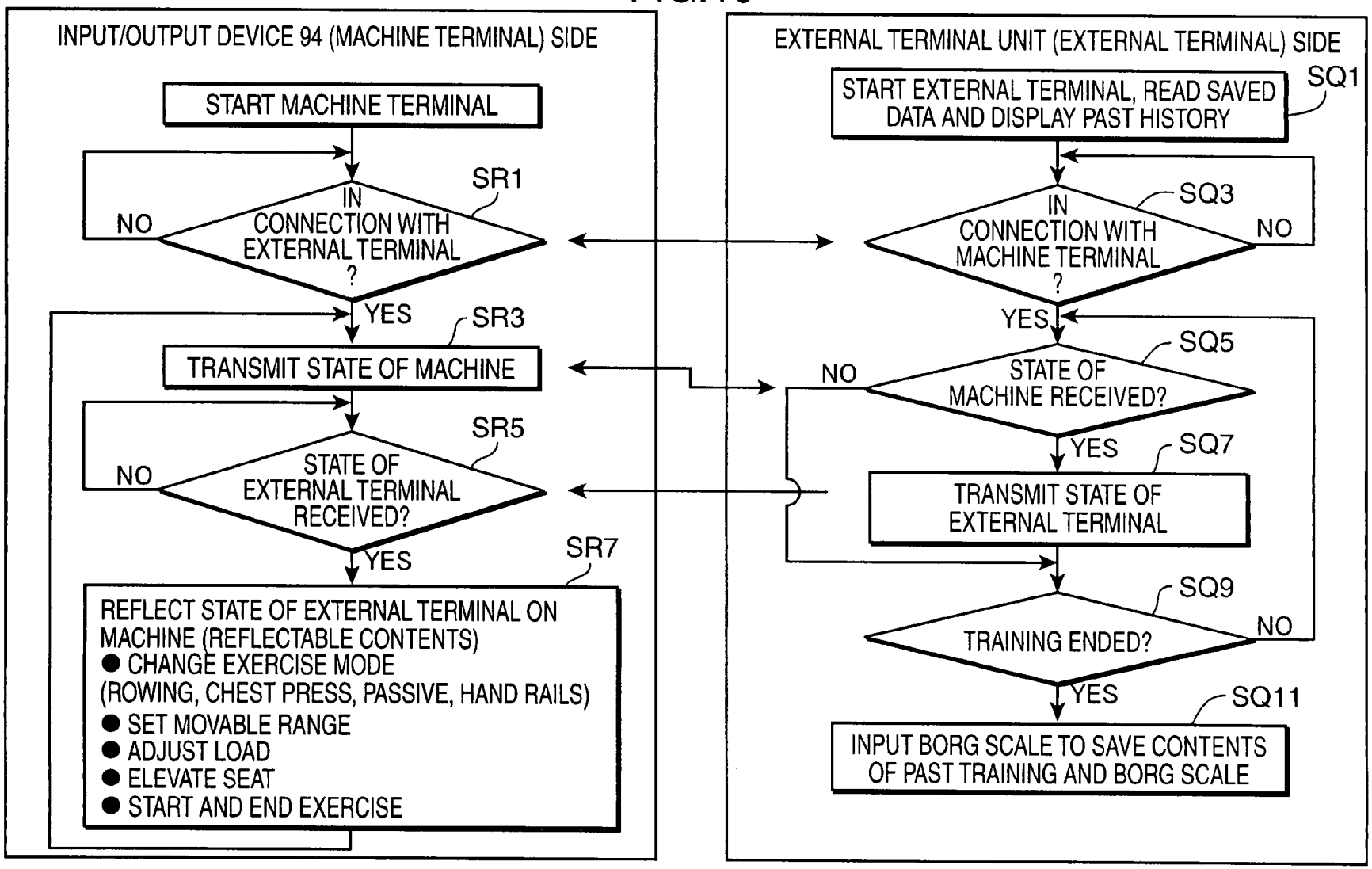
FIG. 10 is a flow chart showing the flow of a data communication processing between an input/output device as a terminal of the machine and an external terminal unit.

FIG. 10 is a flow chart showing a data communication between the input/output device 94 as a terminal of the machine and the external terminal unit. When both the input/output device 94 and the external terminal unit are turned on, the input/output device 94 is started (Step SR1) and, then, the transmission of a handshake signal used for judgment as to connection with the external terminal unit and a standby state waiting for the reception of a signal from the other side are repeated in specified cycles.

On the other hand, when the external terminal unit is started, stored data are read and a past history is displayed on the LCD 95 (Step SQ1). Then, the transmission of a handshake signal (Step SQ3) used for judgment as to connection with the input/output device 94 and a standby state wafting for the reception of a signal from the other side are repeated in specified cycles. Both sides can recognize to be in connection with each other by receiving the handshake signals from the other sides and returning response signals to the other sides.

Subsequently, information presently set in the training machine (machine information) is transmitted from the input/output device 94 to the external terminal unit (Step SR3). When this signal is received by the external terminal unit (Step SQ5), present setting/instruction information of the external terminal unit (state of the external terminal unit) is transmitted (Step SQ7). On the other hand, unless receiving the machine information, the external terminal unit waits on standby until receiving it.

If the input/output device 94 receives the present setting/instruction information of the external terminal unit in Step SR5, Step SR7 follows, where contents of setting in the machine are changed in accordance with the present setting/instruction information of the external terminal unit.

On the other hand, whether or not the training has been ended is judged in the external terminal unit (Step SQ9) if receiving no machine information from the input/output device 94 or after transmitting the present setting/instruction information thereof. Unless the training has been ended, this routine returns to Step SQ5 to receive information on the latest state of the training machine.

If it is judged in the external terminal unit that an instruction was given to end the training, whether or not a Borg scale (indicate objective exercise intensity: whether the training this time was hard or easy is expressed in the form of a scale) has been inputted is confirmed, and the contents of training and the Borg scale are saved (Step SQ11) if the Borg scale is inputted.

On the other hand, upon receiving a signal representing the end of the training from the external terminal unit, the machine operation is ended in accordance with this instruction signal in the input/output device 94 (Step SR7).

The present invention is not limited to the foregoing embodiment and also embraces the following contents.

(1) Although the arched arms 61 are so locked as not to move at all while being set at the closest positions T1 in the foregoing embodiment, the present invention is not limited to the complete locking of the arched arms 61 set at the closest positions T1, and the arched arms 61 may have their movements restricted with a weak force that can be easily surpassed.

(2) Although the arched arms 61 are locked while being set at the closest positions Ti in the foregoing embodiment, they may be locked at specified set positions other than the closest positions T1 instead. It is particularly preferable to lock the arched arms 61 in such a state where the leading end portions (portions near the grips 611, 612) are horizontally held.

(3) Although the arched arms 61 bulge out forward in the foregoing embodiment, the shape of the arched arms 61 is not limited to the arcuate shape according to the present invention. Any shape can be employed provided that the leading end portions of the arched arms 61 set at the closest positions T1 are horizontally held and function as hand rails.

(4) Although the servo motor 81 is employed as a mechanism for locking the movements of the arched arms 61 in the foregoing embodiment, the locking mechanism is not limited to the servo motor 81 according to the present invention and an ordinary motor may be employed.

(5) Although the bottom ends of the arched arms 61 are coupled by the bridging rod 64 in the foregoing embodiment, this bridging rod 64 may be omitted and both arms 61 may be individually rotated if motors to give loads are provided for the respective left and right arched arms 61 despite an increase in the number of parts.

(6) Although the electrical load generating unit is so constructed as to generate a load in accordance with an external force exerted to the arm unit in the foregoing embodiment, the arm unit may simply make rotary movements regardless of an external force and the training person M may simply hold the grips to follow the rotary movements of the arm unit. In this case, the training machine can be used as a rehabilitation machine particularly for people having weakened muscles.

(7) Although the external terminal unit is capable of conducting a wireless communication with the input/output device 94 of the training machine 10 in the foregoing embodiment, the communication between the external terminal unit and the input/output device 94 of the training machine 10 is not limited the wireless communication and may be a wired communication according to the present invention.

In summary, the present invention is directed to a training machine for training the muscles of an upper body of a training person sitting on a seat unit provided in a machine main body, comprising a pair of rotatable arms disposed in the vicinity of left and right sides of the seat unit; and an electrical load generating unit for electrically generating a load in accordance with external forces exerted to the arms, each arm having the bottom end thereof rotatably supported about a supporting shaft extending in horizontal transverse direction and having such a curved shape that a middle part thereof bulges out forward, a leading end portion thereof serving as a grip, and the rotation thereof being lockable by the electrical load generating unit.

With this construction, the training person can train the muscles of his upper body by exercising such training as to rotate the arms forward and backward against the specified load while sitting on the seat unit provided in the machine main body of the training machine and gripping the arms.

Since the arms have the bottom ends thereof rotatably supported about the supporting shafts extending from the seat unit in horizontal transverse direction intersecting with sitting direction, and have such a curved shape that the middle parts thereof bulge out forward, the arched arms can be utilized as hand rails when the training person sits on or get off the seat unit. By gripping the arms as the hand rails, the training person can easily sit on and get off the seat unit regardless of his height and situation (whether he is elderly or too young or physically handicapped). Here, the rotation of the arms can be locked by the electrical load generating unit. Since the rotation of the arms is locked in such a state as to assist movements of the training person to sit on and get off the seat unit, there is no such inconvenience that the arms inadvertently rotate when the training person sits on and gets off the seat unit. Therefore, the training person can safely sit on and get off the seat unit.

Preferably, the arms are rotatable between a farthest position where the grips are farthest from the seat unit and a closest position where the grips are closest to the seat unit, and have the rotation thereof locked while being set at the closest position.

With this construction, since the arms do not project forward when the training person approaches the seat unit to sit on it, they do not stand as a hindrance. In addition, since the middle bulging parts of the arms face substantially upward, they are locked at such positions as to be easily gripped as the hand rails. Therefore, a machine easy to use by training people, particularly elderly training people can be provided.

Since the rotation of the arms are locked in such a state where the portions thereof near the leading ends are held horizontally and closest to the seat unit so as to be able to assist the training person in sitting on and getting off the seat unit, there is no such inconvenience that the arms inadvertently rotate when the training person sits on and gets off the seat unit. Therefore, the training person can safely sit on and get off the seat unit.

Preferably, the seat unit includes a seat on which buttocks are placed and a seat back rest standing at the rear side of the seat.

With this construction, since the training person can lean his back on the seat back rest while sitting on the seat unit, he can rotate the gripping arms forward while straining his back, thereby being able to exert a large power and improving training effects.

Preferably, the pair of arms have the bottom ends thereof coupled by a bridging member extending in horizontal direction, and the bridging member is located at least more backward than the front edge of the seat unit.

With this construction, it is not necessary to provide a motor as the electrical load generating unit for each of the left and right arms, and a load of a motor provided at one side can be transmitted to both arms. By disposing the bridging member, which functions to transmit the load, at least more backward than the front edge of the seat unit, the training person can more easily sit on and get off the seat unit since no hindering member is present before the seat unit when the training person sits on or get off the seat unit.

Preferably, the training machine further comprises a control unit for controlling exercising movements of the training, and an input device used to enter a training menu to the control unit, wherein the control unit includes a control signal output section for outputting a control signal to the electrical load generating unit to set a load conforming to menu information from the input device.

With this construction, the control signal output section of the control unit outputs a control signal to the electrical load generating unit to set a load conforming to the menu information by entering the menu information of the training to the control unit via the input device. Thus, the load for the arms set by the electrical load generating unit is a proper one conforming to the training menu. Further, since the mechanical construction is quite simple as compared to conventional machines utilizing weights or the like, this contributes to a reduction in the number of parts and a reduction in installation cost. Furthermore, although time and labor have been conventionally taken to remove or add weights upon adjusting the load, these operations can be simplified.

Preferably, the electrical load generating unit includes a servo motor, and the electrical load is adjusted by controlling the state of power supply to the servo motor.

With this construction, by employing the servo motor as the electrical load generating unit, the load for the arms can be adjusted only by controlling the state of power supply to the servo motor, facilitating a load adjusting operation. Further, the locking of the rotation of the arms can be easily realized by utilizing a locking function of the servo motor.

Preferably, the training machine further comprises a mounting portion for mounting the input device at a position before the seat unit such that an operation surface of the input device faces the seat unit.

With this construction, the training person can easily perform an input operation since facing the operation surface of the input device by sitting on the seat unit.

Preferably, the training machine further comprises a receiving unit for the wired or wireless reception of input information from an external operating device used to enter a training menu.

With this construction, the training menu can be entered in the training machine through an input operation from the external operating device, training effects can be improved, for example, by a trainer operating the external operating device to give guidance. Accordingly, the training can be safely and securely exercised even if the training person is, for example, an elderly person and unaccustomed to the training machine and takes a lot of trouble in operating the training machine.

This application is based on patent application No. 2005-276166 filed on Sep. 22, 2005 with the Japan Patent Office, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A training machine for training muscles of an upper body of a training person, comprising:

a machine main body;

a seat unit provided supported by the machine main body, the seating unit being disposed to orient the training person facing in a forward direction of the training machine, a horizontal transverse direction of the training machine extending between left and right sides of the seat unit, the seat unit including a seat upon which the training person sits, the seat having a seat front side over which legs of the training person extend, and left and right scat sides;

a pair of rotatable arms disposed in a vicinity of left and right sides of the seat unit;

an electrical load generating unit for electrically generating a load in accordance with external forces exerted to the arms;

each of the arms having a bottom portion thereof rotatably supported about a supporting shaft which extends substantially in the horizontal transverse direction, and each of the arms having such a curved shape at a middle part thereof and an upper portion terminating in a upper end portion thereof configured as a grip, and the rotation of the arms being lockable by the electrical load generating unit;

the arms being rotatable between a farthest position whereat the grips are farthest from the seat unit and a closest position whereat the grips are closest to the seat unit, said bottom portions being inclined in a forward direction such that said middle parts of the arms bulge forward of said supporting shafts when said arms are at the closest position, said arms being lockable at said closest position; and each of the supporting shafts having a shaft outer end and a shaft inner end, said shaft inner ends terminating at a position transversely external to a space between first and second vertical planes defined by said left and right scat sides and extending in a front-rear direction orthogonal to said horizontal transverse direction such that the supporting shafts do not extend into an area forward of the seat front side.

2. A training machine according to claim 1, wherein the seat unit includes a seat back rest standing at a rear side of the seat.

3. A training machine according to claim 1, wherein the pair of arms have the bottom portions thereof coupled by a bridging member extending in horizontal direction such that the pair of arms move in unison and like direction, and the bridging member is Located at least more backward than the front edge of the seat unit.

4. A training machine according to claim 1, wherein the pair of arms have the bottom portions thereof coupled by a bridging member extending in horizontal direction such that the pair of arms move in unison and like direction, and the bridging member is located at least more backward than the front edge of the seat unit.

5. A training machine according to claim 2, wherein the pair of arms have the bottom portions thereof coupled by a bridging member extending in horizontal direction such that the pair of arms move in unison and like direction, and the bridging member is located at least more backward than the front edge of the seat unit.

6. A training machine according to claim 1, further comprising a control unit for controlling exercising movements of the training, and an input device used to enter a training menu to the control unit, wherein the control unit includes a control signal output section for outputting a control signal to the electrical load generating unit to set a load conforming to menu information from the input device.

7. A training machine according to claim 1, further comprising a control unit for controlling exercising movements of the training, and an input device used to enter a training menu to the control unit, wherein the control unit includes a control signal output section for outputting a control signal to the electrical load generating unit to set a load confonning to menu information from the input device.

8. A training machine according to claim 6, wherein the electrical load generating unit includes a servo motor, and the electrical load is adjusted by controlling the state of power supply to the servo motor.

9. A training machine according to claim 7, wherein the electrical load generating unit includes a servo motor, and the electrical load is adjusted by controlling the state of power supply to the servo motor.

10. A training machine according to claim 6, further comprising a mounting portion for mounting the input device at a position before the seat unit such that an operation surface of the input device faces the seat unit.

11. A training machine according to claim 7, further comprising a mounting portion for mounting the input device at a position before the seat unit such that an operation surface of the input device faces the seat unit.

12. A training machine according to claim 1, further comprising a receiving unit for the wired or wireless reception of input information from an external operating device used to enter a training menu.

13. The training machine of claim 1 wherein said machine main body includes main body extensions supporting said supporting shafts of said arms at positions forward of said seat front side, and said main body extensions are configured to have opposing inward extension sides positioned transversely external to the space between the first and second vertical planes defined by said left and right seat sides so as to define an open space between said inward extension sides and the seat front side such that access to said seat from a direction forward of said seat is unencumbered.

14. The training machine of claim 13 wherein each of said arms have an upper arm portion between said bulge and said upper end thereof, said arms are lockable simultaneously at like positions with each of said arms having said bulge positioned forward of said seat front side, and said upper end positioned rearward of said seat from side.

15. The training machine of claim 1 wherein each of said arms have an upper arm portion between said bulge and said upper end thereof, said arms are lockable simultaneously at like positions with each of said arms having said bulge positioned forward of said seat front side, and said upper end positioned rearward of said seat front side.

16. The training machine according to claim 1 wherein each of said arms is configured such that said upper portion is inclined rearward from said middle part toward said grip, the middle part bulges forward a maximum amount when said arm is at said farthest position, and the middle part bulges forward a minimum amount when said arm is at said closest position, and said grip is at a most forward position when said arm is at the farthest position.

17. A training machine for training muscles of an upper body of a training person, comprising:

a machine main body including a base;

a seat unit provided supported by the machine main body, the seat unit being disposed to orient the training person facing in a forward direction of the training machine, a horizontal transverse direction of the training machine extending between left and right sides of the seat unit, the seat unit including a seat upon which the training person sits, the seat having a seat front side over which legs of the training person extend, and left and right seat sides;

a pair of rotatable arms disposed in the vicinity of the left and right sides of the seat unit, each of the arms includes a top end portion configured as a grip, a lower portion, and a middle part connecting said top end portion and said lower portion;

a pair of support members disposed adjacent left and right sides of the seat unit for rotatably supporting said rotatable arms, each of said support members includes:

a support bracket mounted on the base; and a supporting shaft rotatably supported on said support bracket and extending in the horizontal transverse direction, the supporting shaft rotatably supporting the lower portion of a corresponding one of said rotatable arms;

each of the supporting shafts having a shaft outer end and a shaft inner end, said shaft inner ends terminating at a position transversely external to a space between first and second vertical planes defined by said left and right seat sides and extending in a front-rear direction orthogonal to said horizontal transverse direction such that the supporting shafts do not extend into an area forward of the seat front side;

the arms being rotatable between a farthest position whereat the grips are farthest from the seat unit and a closest position whereat the grips are closest to the seat unit. said lower portions being inclined in a forward direction such that said middle parts of the arms bulge forward of said supporting shafts when said arms are at the closest position; and an electric load generating unit for electrically generating a load in accordance with external forces exerted to the arms, said electric load generating unit having a locking operation to lock rotation of the arms, said arms being lockable at said closest position.

18. A training machine for training muscles of an upper body of a training person, comprising:

a machine main body including a base;

a seat unit provided supported by the machine main body. the seat unit being disposed to orient the training person facing in a forward direction of the training machine, a horizontal transverse direction of the training machine extending between left and right sides of the seat unit, the seat unit including a seat upon which the training person sits, the seat having a seat front side over which legs of the training person extend, and left and right sides;

a pair of rotatable arms disposed in the vicinity of the left and right sides of the scat unit, each of the arms includes a top end portion configured as a grin, a lower portion, and a middle part connecting said top end portion and said lower portion;

a pair of support members disposed adjacent left and right sides of the seat unit for rotatably supporting said rotatable arms, each of said support members includes;

a support bracket mounted on the base; and a supporting shaft rotatably supported on said support bracket and extending in the horizontal transverse direction, the supporting shaft rotatably supporting the lower portion of a corresponding one of said rotatable arms;

each of the supporting shafts having a shaft outer end and a shaft inner end, said shaft inner ends terminating at a position transversely external to a space between first and second vertical planes defined by said left and right seat sides and extending in a front-rear direction orthogonal to said horizontal transverse direction such that the supporting shafts do not extend into an area forward of the seat front side;

an electric load generating unit for eleetrieally generating a load in accordance with external forces exerted to the arms, said electric load generating unit having a locking operation to lock rotation of the arms;

a bridging member which extends in the horizontal traverse direction for connecting lower ends of the arms, said bridging member being located rearward the seat front side, of the seat unit; and said lower ends of said arms being positioned rearward and distal from portions of the arms supported by said support member.

19. The training machine of claim 18 wherein said machine main body includes main body extensions including said base areas supporting said supporting members, and said main body extensions are configured to be transversely external to the space between the first and second vertical planes defined by said left and right seat sides such That access to said seat from a direction forward of said seat is unencumbered.

20. The training machine of claim 19 wherein each of said middle parts of said arms are curved portions, said arms are lockable simultaneously at like positions with each of said arms having said curved portion positioned forward of said seat front side, and said grip positioned rearward of said seat front side.

21. The training machine of claim 18 wherein said bridging member fixes together said lower ends such that said arms move in unison in like direction.

22. The training machine according to claim 16 wherein said upper portion of each of said arms is substantially horizontal and closest to said seat unit when said arms are at said closest position.

* * * * *